United States Patent [19]

Eickmann

[11] Patent Number: 4,478,133

[45] Date of Patent: Oct. 23, 1984

[54] ARRANGEMENT ON MEMBERS WHICH OSCILLATE OR PIVOT

[76] Inventor: Karl Eickmann, 2420 Isshiki, Hayama-machi, Kanagawa-ken, Japan

[21] Appl. No.: 110,080

[22] Filed: Jan. 7, 1980

Related U.S. Application Data

[63] Continuation-in-part of Ser. No. 765,221, Feb. 3, 1977, Pat. No. 4,193,336, which is a continuation-in-part of Ser. No. 528,346, Nov. 29, 1974, Pat. No. 4,037,523.

[51] Int. Cl.[3] ..... F01B 13/06

[52] U.S. Cl. ..... 91/488; 92/258

[58] Field of Search ..... 91/488, 491, 498; 92/258, 58; 47/273; 403/114, 123

[56] References Cited

U.S. PATENT DOCUMENTS

| | | | |
|---|---|---|---|
| 2,010,587 | 8/1935 | Fischer et al. | 403/114 |
| 3,223,046 | 12/1965 | Eickmann | 92/58 |
| 3,255,706 | 6/1966 | Eickmann | 92/58 |
| 3,273,511 | 9/1966 | Eickmann | 417/273 |
| 3,828,653 | 8/1974 | Aldinger | 92/258 |

FOREIGN PATENT DOCUMENTS

| | | | |
|---|---|---|---|
| 85452 | 4/1895 | Fed. Rep. of Germany | 403/114 |
| 2643548 | 3/1978 | Fed. Rep. of Germany | 91/488 |
| 2817987 | 10/1978 | Fed. Rep. of Germany | 91/488 |
| 1506393 | 9/1966 | France | 91/180 |

*Primary Examiner*—William L. Freeh

[57] ABSTRACT

A member oscillates on a face and another member pivots on a bed of the first member. Passages are provided through the members to lead a lubrication fluid under pressure into a fluid pocket between the mentioned face and one of the members. The fluid pressure in the pocket carries a major portion of the load of one of the members on the face. The oscillation of the members has one stroke under higher load and one under less load. The pivotal movement of the other member controls the flow of fluid through the passages to provide high pressure in the fluid pocket at the stroke under higher load and lower pressure in the pocket at the stroke under less load. The arrangement is especially suitable to be provided on pistons and piston shoes of fluid handling machines. But it can also serve to carry load on other members of machines or vehicles, wherein at least two movements are taking place and a source of supply of fluid under pressure is available.

7 Claims, 28 Drawing Figures

Fig. 16
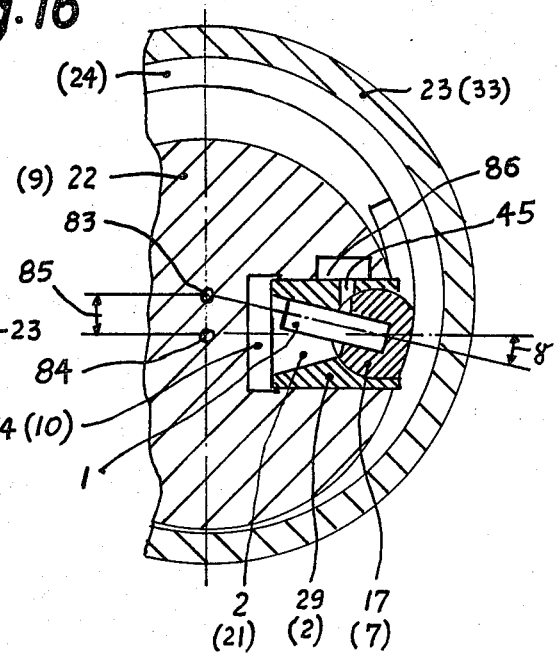
Fig 17
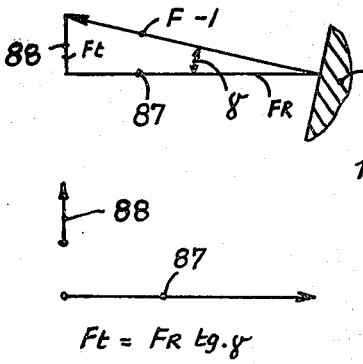
Fig. 18
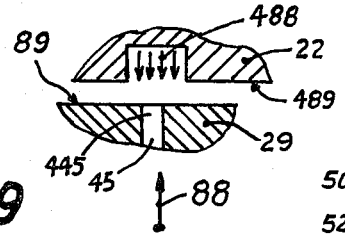
Fig. 20
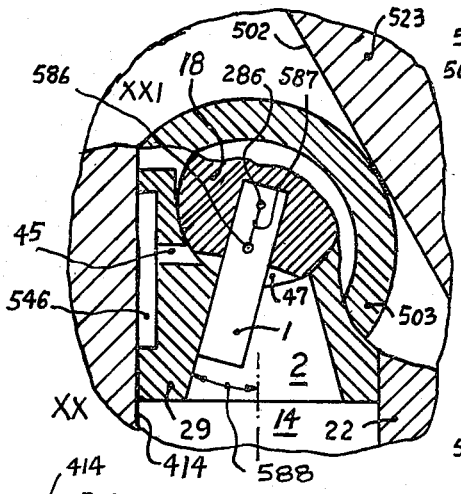
Fig. 19
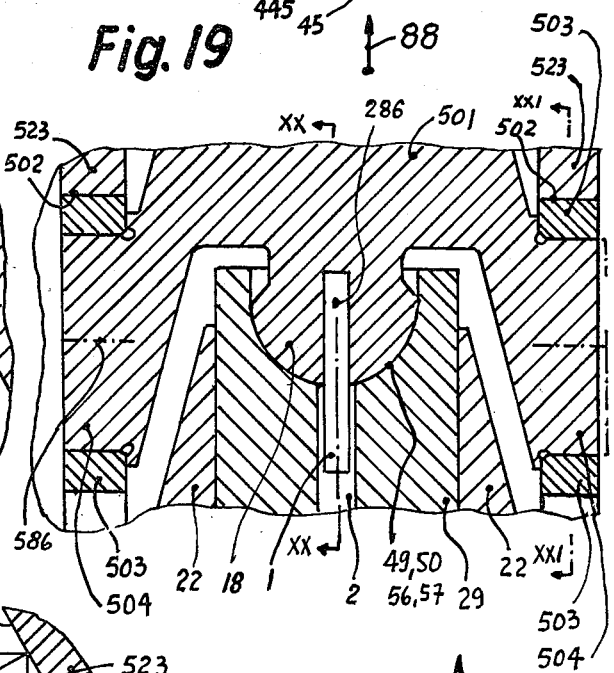
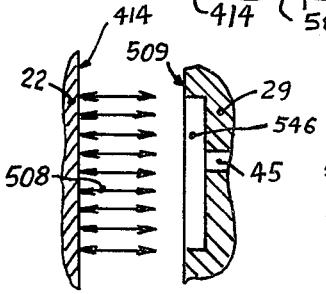
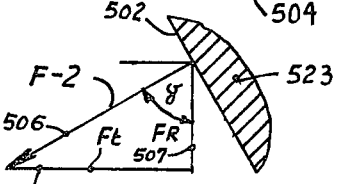
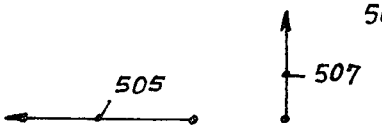
Fig. 21

Fig. 23
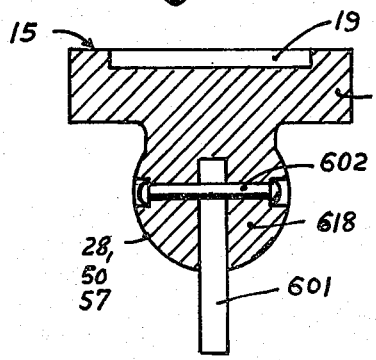
Fig. 22
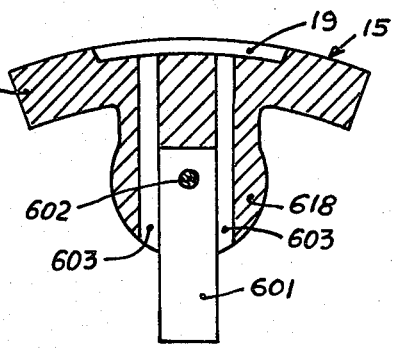
Fig. 24
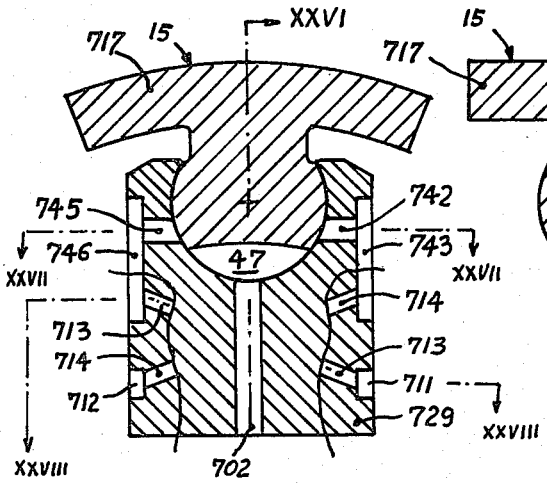
Fig. 26
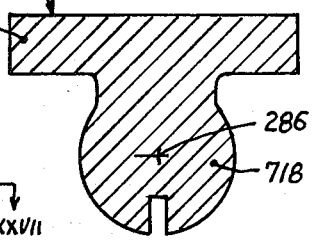
Fig. 25
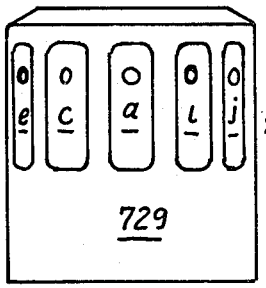
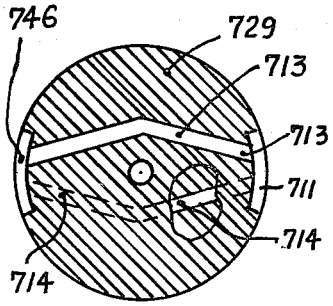
Fig. 28
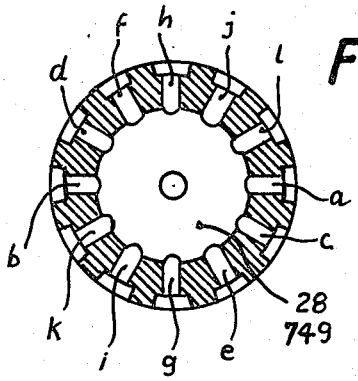
Fig. 27

ARRANGEMENT ON MEMBERS WHICH OSCILLATE OR PIVOT

REFERENCE TO RELATED APPLICATIONS

This is a continuation in part application of my co-pending patent application Ser. No. 765,221 which was filed on Feb. 3rd, 1977.

The mentioned co-pending application Ser. No. 765,221 is a continuation in part application of my earlier application Ser. No. 528,346 of Nov. 29th, 1974, which is now U.S. Pat. No. 4,037,523; which issued on July 26th, 1977. FIGS. 13 to 15 of the present application correspond to FIGS. 32 to 35 of the mentioned parental application Ser. No. 765,221 while all other Figures of the present application bring improvements or modifications of the mentioned Figures of the mentioned parental application.

The mentioned patent application Ser. No. 765,221 which was co-pending at the date of filing of the present patent application, is now U.S. Pat. No. 4,193,336, which issued on Mar. 18th, 1980. Priority of Feb. 3rd, 1977 of the parental application Ser. No. 765,221 is claimed partially for this present continuation in part application.

BACKGROUND OF THE INVENTION

In my elder U.S. Pat. No. 3,255,706 I have disclosed a fluid pressure pocket in a piston wall to reduce the friction between the cylinder and the wall.

In said patent however, the piston carried a part-cylindrical pivot-portion of a piston shoe, whereby the piston shoe prevented a rotation of the piston around the axis of the piston.

In my grand-parental application, which is now U.S. Pat. No. 4,037,523, I have also disclosed a part-spherical pivot-member on a piston shoe, borne on a complementary formed bed on the piston. Such part-spherical pivot-portions are also common in the former art.

The part-spherical pivot portions can not prevent a rotation of the piston relatively to the piston shoe.

The piston however exert during pivotion of the piston shoe a lateral or tangential load onto the wall of the cylinder wherealong the piston slides. This load is in the direction of an imaginary plane constituted by the move of the imaginary axis of pivotion of the piston shoe.

Since the part-spherical pivot-portion of a piston shoe can not prevent a rotation of the piston relatively to the piston shoe, the fluid pressure pocket in the piston, when applied, might move out of the direction of said load and thereby prevent the desired carrying of the load by the fluid pressure pocket. It might even transfer the force in the fluid pressure pocket by rotating the piston to another, undesired direction. It would then press the piston on the opposite side against the cylinder wall and thereby increase the friction between the oscillating or reciprocating piston and the wall of the cylinder so drastically, that the device with the pocket would be of less efficiency than a device without a fluid pressure pocket in the piston.

THE AIMS AND OBJECTS OF THE INVENTION

The aim of the invention is, to prevent such rotation of a piston relatively to a piston shoe and thereby to prevent the increase of friction and to provide an assembly to prevent rotation of a piston relatively to a shoe with part-spherical pivot-portion in order to make the provision of fluid pressure balancing pockets in such pistons possible, which carry such part-spherical pivot-portion.

At research of the mentioned aim of the invention, it has now been found, that the arrangement of the invention is not only applicable in hydraulic or pneumatic pumps or motors with pistons and piston shoes, but also in other machines or vehicles and generally in devices, where two members move relatively to each other and one of the members moves along a body, when a source for supply of pressure is available and when the body contains means to restrict the size of the respective movements to keep the arrangement in place and together.

The main objects of the invention are obtained by the following arrangements:

An arrangement to reduce friction in a device which includes at least two bodies, two members and two faces which slide along each other under a pivoting load;

wherein one of said bodies contains a space for the reception of at least a portion of one of said members;

wherein one of said members is provided with a bed to bear thereon a pivot portion of the other of said members;

wherein said members are pivoting relative to each other in alternating opposite directions when one of said members is borne in said bed of the said other of said members;

wherein one of said members does a movement in said space whereby it slides with its outer face along a respective wall-face of said space, wherein said bodies include retaining portions located on opposite ends of said members to limit the extent of said movement, wherein at least one of said bodies forms retaining-walls on two opposite sides of one of said members;

wherein at least one pocket is provided in one of said members and open toward said wall-face of said space;

wherein one of said members is provided with a first passage means communicated to a chamber with fluid under pressure and a second passage means communicating with said pocket;

wherein a third passage means is provided in the other of said members for communication with said first passage means and alternating communication and discommunication with said second passage means during pivoting of said members;

wherein at least one of said members has an inner recess of a non-circular cross-section;

wherein said recess is open toward the other of said members;

wherein an element of a cross-section at least partially complementary to said cross-section of said recess is associated to said members, extending into both of said members and extending into said recess;

wherein said passages supply fluid into said pocket; serve to maintain at least periodically fluid and pressure in said pocket and to carry at least a portion of the load of said member on said wall-face;

wherein said pocket is located in the direction of the load of the respective member on said wall-face;

wherein said movement is an oscillation with a stroke under load and another stroke under less load;

wherein said movement is provided in the concentration of the load of the respective member on said wall-face and in the direction of said load; and;

wherein said recess and said element serve to maintain a first equal direction of said members relatively to each other whereby they maintain said direction of said load and keep said movement in said concentration and direction of said load by preventing displacement of said pocket out of said concentration and direction of said load.

Or; the arrangement of above, wherein said retaining-walls guide said sides of said one member for maintenance of one direction of said member and whereby said recess and said element transfer said maintenance to said other member to maintain one of the directions of said other member and thereby to maintain said pocket in said concentration and direction of said load.

Or; the arrangement of above, wherein the other of said members has a second inner recess and said element extends into both of said inner recesses.

Or; the arrangement of above, wherein said element is borne in one of said inner recesses by a bar extending through said element and into one of said members.

Or; the arrangement of above, wherein said element is freely able to move in axial direction of said element in said recesses, wherein said limit of extent of said movement is shorter than the length of said element and wherein at least one of said members is longer in said direction of said axis than said limit, whereby escape of said element from said recesses in said members is prevented.

Or; the arrangement of above, wherein said recess includes an enlargement in one direction to facilitate in said enlargement a pivotal motion of said element relatively to one of said members.

Or; the arrangement of above, wherein said bodies are actuating said movement.

Or, the arrangement of above, wherein one end of said element is fastened in one of said members and carries a holding means to keep the other of said members between said one of said members and said holding means.

Or; the arrangement of above, wherein said other member includes a holding face to carry said holding means thereon and said holding face is of a suitable configuration to permit a smooth slide of said holding means along said holding face during said pivotal movement of said members.

More solutions, features, objects or aims of the invention may become appearant from the description of the preferred embodiments and the drawings.

In some of the embodiments of the invention, which are certain modifications from the main embodiment or which include such modifications, the following objects might appear:

The arrangement of the above; wherein said pocket is constituted by the outer port of said second passage means and an additional wall-pocket is provided in and through the respective wall of said space in one of said bodies and porting into said outer port of said pocket.

Or; the arrangement of above; wherein one of said members moves along a face which is inclined more than 45 degrees to said movement; said members thereby form a transmission of power into a greater force than that which acts in the direction of said movement; and said at least one pocket carries a major portion of said greater force.

Or; an arrangement to reduce friction in a device which includes at least two bodies, two members and two faces which slide along each other under a pivotal load;

wherein one of said bodies contains a space for the reception of at least a portion of one of said members;

wherein one of said members is provided with a bed to bear thereon a pivot portion of the other of said members;

wherein said members pivot relatively to each other in alternating opposite directions when one of said members is borne in said bed of the said other of said members;

wherein one of said members does a movement in said space whereby it slides with its outer face along a respective wall-face of said space;

wherein said bodies include retaining portions located on opposite ends of said members to limit the extent of said movement;

wherein at least one of said bodies forms retaining-walls on two opposite sides of one of said members;

wherein at least one pocket is provided in one of said members and open toward said wall-face of said space;

wherein one of said members is provided with a first passage means communicated to a chamber with fluid under pressure and a second passage means communicating with said pocket;

wherein a third passage means is provided in the other of said members for communication with said first passage means and alternating communication and discommunication with said second passage means during pivotal movement of said members;

wherein at least one of said members has an inner recess of a non-circular cross-section;

wherein said recess is open toward the other of said members;

wherein said passage supply fluid into said pocket; serve to maintain fluid and pressure in said pocket and to carry at least a portion of the load of said member on said wall-face;

wherein said pocket is located in the direction of the load of the respective member on said wall-face;

wherein said movement is an oscillation with a stroke under load and another stroke under less load;

wherein said movement is provided in the concentration of the load of the respective member on said wall-face and in the direction of said load;

wherein said recess forms said third passage means to provide a transfer of fluid pressure into said pocket;

wherein said retaining walls are providing a keeping for one of said members to keep it aligned in at least one direction, thereby making said member into a non-rotary member;

wherein said recess is provided in said non-rotary member;

wherein said members are free of devices to prevent rotation of one of said members relatively to the other of said members, whereby one of said members becomes a rotatable member;

wherein said at least one pocket consists of a plurality of individual pockets angularly spaced around the periphery of said rotatable member and each individual pocket has an individual passage of said second passage means;

wherein said recess in said non-rotary member is so narrow in one of its dimensions, that it communicates during said communication only with those individual passage(s) of said second passage means and that individual pocket(s) of that at least one pocket, which are located substantially in the said concentration of said load; whereby it forms a selection of communication to passages and pockets;

and;

wherein said recess, said transfer, said keeping and said selection are utilized to maintain said pocket in said direction of said load and on said movement in said concentration and direction of said load by preventing the passing of fluid to pockets, which are out of said load and by passing of fluid into at least one of said pocket which is present at the respective time in said concentration and direction of said load.

BRIEF DESCRIPTION OF THE DRAWING

FIG. 16 is a cross-sectional view through another embodiment of the invention.

FIG. 17 is a diagram;

FIG. 18 is an enlargement of a portion of FIG. 16.

FIG. 19 is a longitudinal sectional view through a still further embodiment of the invention.

FIG. 20 is a sectional view through FIG. 19 along XX—XX.

FIG. 21 demonstrates a schematic explanation.

FIG. 22 is a cross-sectional view through another member of the invention.

FIG. 23 is a sectional view through FIG. 22 along XXIII—XXIII.

FIG. 24 is a cross-sectional view through two members of another embodiment of the invention.

FIG. 25 is a view onto a member of FIG. 24 along XXV—XXV.

FIG. 26 is a sectional view through FIG. 24 along XXVI—XXVI.

FIG. 27 is a sectional view through FIG. 24 along XXVII—XXVII, and,

FIG. 28 is a sectional view through FIG. 24 along XXVIII—XXVIII, which demonstrates a provision which might be used or be eliminated, if so desired.

The commonly medially located bars, such as are shown by referentials 1, 2, 7, 288, or 601 are shown in the Figures as seen in a view onto them in order to elevate their importance, as is often done in drawings and technical illustrations.

Elements 1, 5, 7, 288 and 601 are in some of the mentioned Figures shown in views from the outside onto them within the otherwise sectional drawings of the respective Figures.

GENERAL DESCRIPTION OF THE PREFERRED EMBODIMENTS

As far as referential numbers are appearing in parentheses in this description, the parentheses indicate, that the number is the number used in the application or patent, wherefrom the respective Figure is taken.

Figure 2:
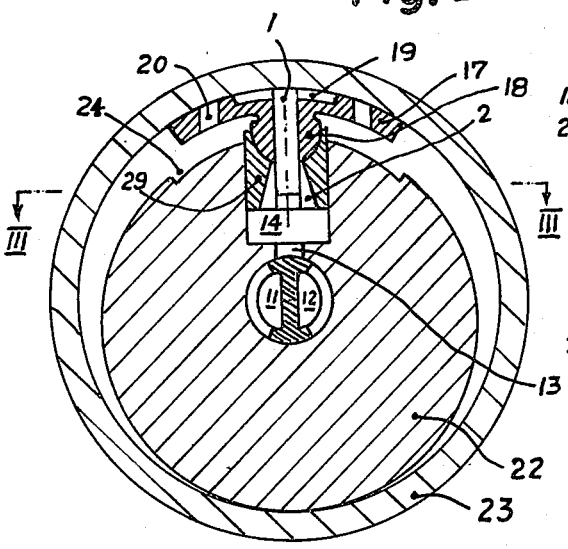
FIG. 2 is a cross-sectional view through FIG. 1 along II—II.
Figure 1:
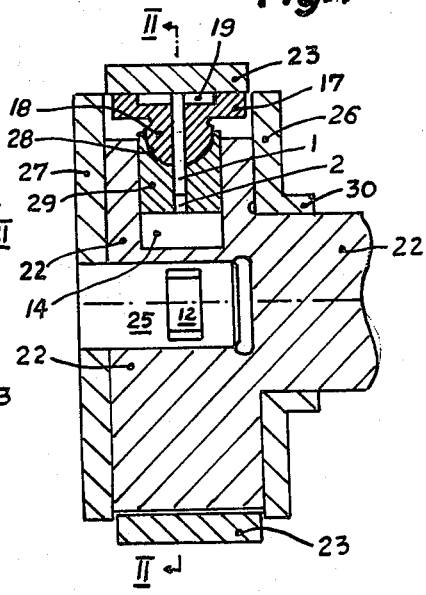
FIG. 1 is a longitudinal sectional view through one embodiment.
Figure 3:
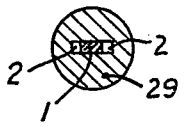
FIG. 3 is a sectional view through FIG. 2 along III—III.

In FIGS. 1 to 3 a body 22 contains a chamber 14, wherein a member 29 reciprocates or oscillates. Chamber 14 contains fluid under pressure. Another member 17 is associated to member 29 and borne on member 29 in a bed 28 by a pivot portion 18. The bed and pivot portion are of complementary part-ball-formed configuration. Part-ball configuration may also be called spherical and it may be the outside of the form of a ball or the inside of a part of a hollow ball.

Another body 23 guides the member 17 and thereby restricts the extent of the movement of the members in one direction. Members 18 and 29 are provided with recesses wherein an element 1 is located. The recesses and the elements are of non-circular cross-section. The mentioned non-circularity prevents rotation of member 29 relatively to member 17 and portion 18.

Body 22 is provided with retaining-walls 26,27 which flank the ends of the sides of member 17, whereby they are forming retaining walls on opposite sides of one of the members.

One of the bodies must contain at least one retaining portion located on opposite ends of the members to limit the extent of the movement of the members. In FIGS. 1 to 2 the bottom of chamber 14 in body 22 forms one such retaining portion and the body 23 forms by its inner face the other retaining portion.

More details will appear from the enlargement Figures.

In FIGS. 1 and 2 is however a control body 25 demonstrated, which contains fluid passages and ports 11 and 12 to lead fluid through passage 13 into and out of chamber 13. That defines the arrangement of these Figures as a radial piston machine, the body 22 as a rotor, the body 23 as a piston stroke guide means or piston stroke actuator; member 29 as a piston, chamber 14 as a cylinder, member 18 as a piston-shoe, portion 18 as a pivot-portion of a piston shoe and bed and faces 28 as pivot bearing means between a piston and a shoe.

Piston 29 draws or draws fluid into chamber 14 and expels it in a delivery stroke, when the piston moves radially inwardly. Rotor 22 may have a shaft 22 and be borne rotatably on control body 25 and bearing 30. The piston shoe 17 may be provided with a fluid pressure pocket 19 to form with the surrounding sealing land a hydrostatic bearing. Slots 20 may restrict the dimension of the hydrostatic bearing. Recess 2 in piston 29 may have a limited extension in one direction to limit a pivotion of holding element 1 in the extension(s) of slot 2.

Figure 6:
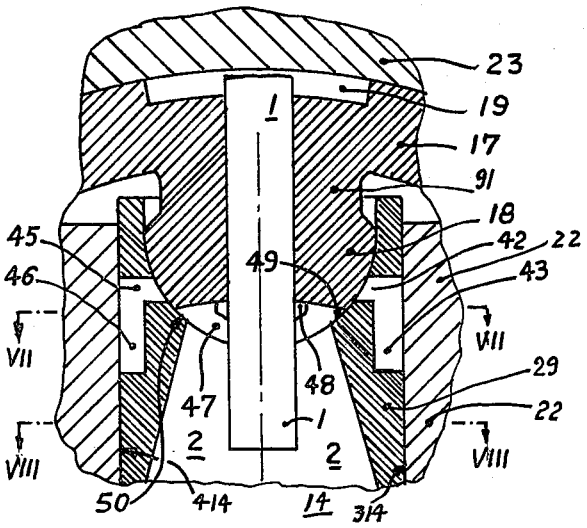
FIG. 6 is an enlargement of a portion of FIG. 1.
Figure 7:
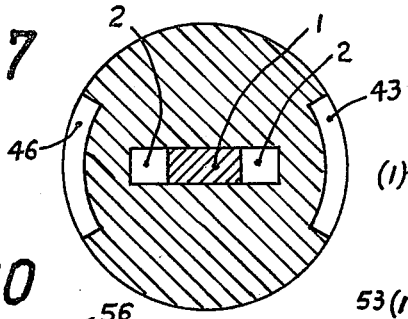
FIG. 7 is a sectional view through FIG. 6 along VII—VII.
Figure 8:
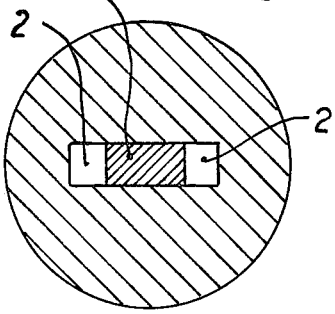
FIG. 8 is a sectional view through FIG. 6 along VIII—VIII.

FIGS. 6 to 8 show a portion of FIG. 2 in an enlarged scale. These Figures explain, that the member 17 has a slot 2 of noncylindrical cross-section, whereinto or wherethrough the element 1 of a configuration fitting into slot 2 is provided. Member 29 reciprocates along a wall-face 314 or 414 of space 14. Member 29 has an outer face and slides with it along the respective wall-face, whereby it is provided, that one of the members does a movement in the mentioned space, whereby it slides with its outer face along a respective wall-face of the mentioned space.

Thereby is also provided, that two faces, namely the outer face of member 29 and the wall-face of space 14, slide along each other.

The body 23 of FIG. 2 has an axis which is eccentrically spaced from the axis of body 22. Thereby it is provided, that member 17 pivots on member 29, when one of the members rotates or varifies its position. This fact provides a pivoting load by member 17 onto member 29, when member 17 pivots out of the neutral position relatively to member 29 when load is applied in chamber 14. The mentioned load produces a component of force or of load perpendicular or normal to the axis of piston member 29 in a direction normal onto the wall-face 414 or 314.

Thereby it is provided, that two faces slide along each other under a pivoting load.

Since member or piston 29 is reciprocating in cylinder or space 14 of body 22, it is also provided, that one of the bodies contains a space for the reception of at least one portion of one of the members.

Body or piston 29 has on its head a hollow face 49 of part-ball configuration, which forms a bearing bed 49 to bear thereon the pivot portion 18 of the other member or piston shoe 17 of the other member.

Piston shoe pivot-member 18 has an outer face 50 of a part of a ball, which is complementary to the face or bed 49 and able to be borne thereon and to swing or pivot thereon. Since further, as already described, a pivot-motion is forced onto member 17 by the bodies 22 and 23, it is provided, that both members 17 and 29 or portion 18 of member 17 and member or piston 29 pivot relatively to each other in alternating opposite directions, when one of the members 17–18 or 29 is borne in the respective bed 49 or by the spherical bearing 49–50 between the members or of the other member 17–18 or 29.

When the described eccentricity is provided between the axes of bodies 22 and 23 and body or rotor 22 revolves around its axis, the members 17 and 29 are forced inwardly by body 23 into space 14 and outwardly by pressure in fluid in space 14. Thereby it is provided, that one of the bodies, namely body or piston 29 does a movement in space 14, namely an oscillating or reciprocating movement in space or cylinder 14, whereby member 29 slides with its outer face along the respective wall face 314,414 of the respective space 14.

The inner face of body 23 and the bottom of space 14 include on the bodies 22 and 23 retaining portions located on opposite ends of members 17 and 29 to limit the extent of the described movement, namely of the reciprocating movement of piston 29 with its outer face along the respective wall face 314,414 of the respective space, for example of cylinder 14.

Since body 22 of one of the bodies 22 and 23 is associated to walls 26 and 27, which may be integral with body 22 or 23 or be attached to body 22 or 23, it is provided, that the at least two bodies 22 and 23 include retaining portions 26, 27 located on opposite sides of member 17 of one of the members 17 and 29.

In FIGS. 6 and 7 it is clearly visible, that at least one pocket is provided in one of the members, and that the mentioned pocket is open toward the mentioned wall-face of the mentioned space. For example the FIGS. 6 and 7 show pockets 43 and 46 in piston or member 29 and they are open toward the respective wall-faces 314 or 414 of space or cylinder 14.

The same Figures show also, that one of the members is provided with a first passage means communicated with a chamber with fluid under pressure and a second passage means communicating with the mentioned pocket. For example recess 2 forms the first passage means and is communicated with chamber or space 14, which contains at least alternatingly fluid under pressure, as described herebefore. The second passage means has in the mentioned Figures two passages 42 and 45 and they communicate with the mentioned pockets 43 or 46 respectively.

These Figures also show, that a third passage means 47 is provided in the other member 17–18 of the members for communication with the mentioned first passage means 2 and for alternating communication and dis-communication with the mentioned second passage means 42 or 45 during pivotion of the members 29 and 17–18 relatively to each other.

In the Figures mentioned, piston shoe or member 17–18 pivots on piston or member 29. Thereby the third passage 47 or control-recess 47 moves alternately during a revolution of body or rotor 22 upwards in the left side of FIG. 6 to communicate with second passage means 45 and thereafter the left side of third passage 47 moves downward and the right side of recess or third passage means 47 moves upward for communication with the other passage 42 of the second passage means 42–45.

Figure 13:
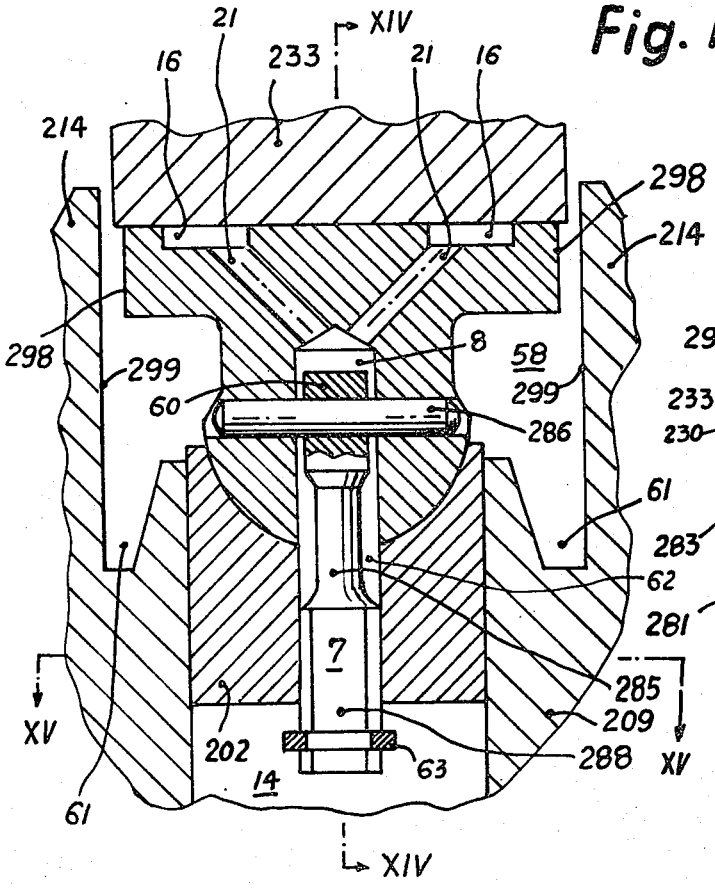
FIG. 13 is a longitudinal sectional view through a further embodiment of the invention.
Figure 14:
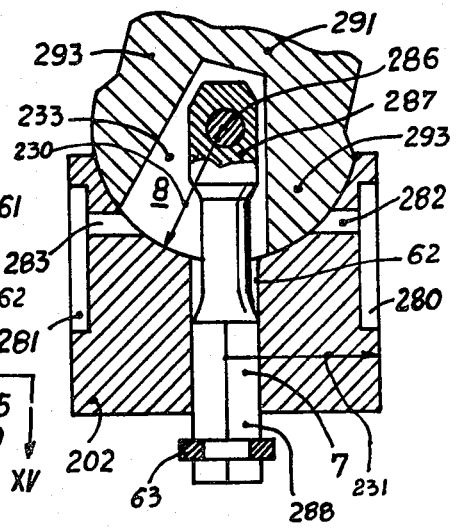
FIG. 14 a sectional view through FIG. 13 along XIV—XIV.
Figure 15:
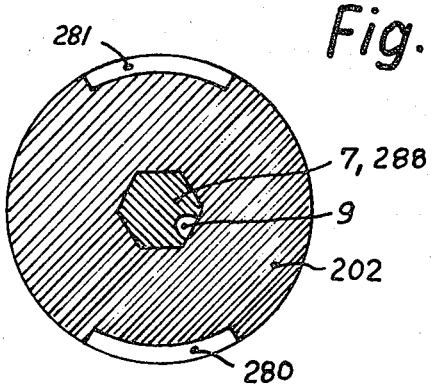
FIG. 15 a sectional view through FIG. 13 along XV—XV.

These Figures also show, that at least one of the members 17,29 has an inner recess of non-circular cross-section. It can be seen for example, that the recess 2 is narrower in FIG. 1 than in FIG. 2. In member 29 as well as in member 17–18. This difference in size makes it clear, that the recess 2 is of a non-circular cross-sectional area or configuration. In FIGS. 1 to 3 and enlargements of FIGS. 6 to 8 it is substantially in rectangular configuration or cross-section. This is best seen in the enlargements shown in FIGS. 7 and 8, which clearly define the non-circular cross-section of recess 7. In FIGS. 13 to 15 the non-circular recess 62 is of a cross-section of a six-angle or hexagon with equal sides and angles.

The Figures here discussed, also show, that the inner recess, for example 2, is open toward the other of the members. For example, the recess 2 in member 29 in FIG. 6 is open towards the other member 17–18. The respective inner recess 2 may even extend through one or both of the members. That is the case in the now discussed Figures. When member 29 is a longitudinal body, for example, a piston, moving in the direction of its longitudinal axis, and the other member 17–18 has a medial portion in the direction of the longitudinal member at pivot angle zero, the inner recess or recesses 2 or others may extend in the direction of the axis of the longitudinal member into or through one or both members. That is the case in many of the Figures, including in FIG. 6.

It is further demonstrated in many of the Figures, that an element 1,3,5 or (109) or (288) in the parental application of non-circular cross-section which is at least partially complementary to the cross-section of the respective inner recess is associated to both members, for example 29,17–18; 202–293; 81–82; or 51,75 or others and that the respective element extends into both of the members and into the respective inner recess 2,62,6, 4 or into another respective inner recess.

In the diagrams 17 and 21 at hand of the respective Figures of this application, whereto the diagrams are explanatory, it is also proven, that the mentioned passages supply fluid into the respective pocket to carry at least a portion of the load of the respective member on the respective wall-face. For example, in FIG. 6 first passage 2 is provided by recess 2 and transfers fluid through the second passage 47 into the respective third passage 42 or 45 and therethrough into pocket 43 or 47, when the member 17–18 pivots into a respective position. The leteral or tangential load of member 29 is then at least partially, almost or totally, carried by the force of fluid in pocket 43 or 46.

Since member 29 can pivot in one dimension only, the lateral or tangential load which it transfers over member 29 into the respective portion of the wall-face 414 or 314 has a specific direction. For example, that in the plane, where FIG. 2 is drawn and in its surrounding neighborhood. FIG. 6 demonstrates, that the pockets 43 or 46 are located in the mentioned plane and thereby in the direction of the load of the respective member. It is shown, that the pocket is located in the direction of the load of the respective member on said wall face.

Thus, when the member or piston 29 moves radially in and out in space 14, its movement is an oscillation with a stroke under load and another stroke under less load. For example, in a pump the inward stroke is a stroke under higher load and the outward stroke is a stroke under less load. In a motor the loading of the strokes is reversed.

The entire member 29 moves along the respective wall face 314, 414 of space 14, but the portion of the member 29 which is pressed against a portion of a wall-face is that portion, wherewith the invention is concerned. The expression "movement" shall therefore concern that portion of the movement, which would be under a high load, when the invention would not be applied.

At such consideration, the movement of the respective member, for example piston 29, is provided in the concentration of the load of the respective member of said wall-face and in the direction of said load.

The so mentioned movement is a portion of the overall movement of the respective member, namely that portion of it, which concerns the invention.

With the above explanations, the aim of the invention is achieved, namely, that said recess and said element serve to maintain a first equal direction of said members relatively to each other, whereby they maintain said direction of said load and keep said movement in said concentration and direction of said load by preventing displacement of said pocket out of said concentration and direction of said load.

Figure 4:
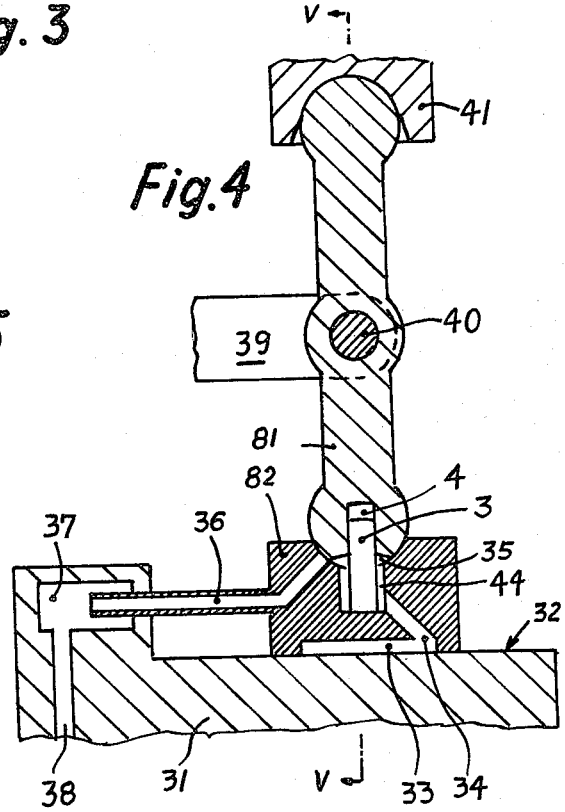
FIG. 4 is a longitudinal sectional view through another embodiment.
Figure 5:
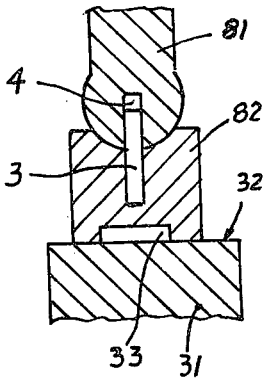
FIG. 5 is a sectional view through a portion of FIG. 4 along V—V.

In FIGS. 4 and 5 a mechanism is demonstrated, which may be used in machines, vehicles or stationary plants, where a movement takes places with a pair of strokes of basically opposite directions, when one of the strokes is under a higher and the other under a less high load.

Member 82 has a movement along the wall-face 32 of a body 31. Another body 29 or 41 drives said movement. A pivoting other member 81 is associated to the other body and pivots in member 82, when member 82 does its movement.

Since there is no specific guidance system for member 82, this member would run in any undesired direction along face 32, when the invention would not be applied.

According to the invention, the location and direction of the movement is supported by means of the invention, and there, where the load appears during movement of member 82 along wall-face 32, the movement becomes according to the invention, provided with the pocket of the invention, to carry at least a portion of the load.

One dimensional direction of one of the members, namely member 81, is maintained by holding means 4o, 39. The alternating load acts downward in the figure and is supplied by body 41. Non-circular recess 3 is provided in member 81 and may be extended in the direction of the movement. A therein fitting, non-circular element 3 of a complementary configuration or cross-section is extended into recess 4 and into recess 44 in member 82. Recess 44 is, as seen in FIG. 4, extended in the direction of the movement wider than the element 3 is. One of the recesses 4 or 44 may be of a size, just to hold member 3, but the other of the recesses 4 or 44 must be elongated in the direction of the movement to permit the pivotion of the respective portion of element 3 in it.

To materialize the aim of the invention in this embodiment of wide application in the different industries, vehicles, machines and the like, a source of fluid under pressure supplies pressuzied fluid through passage 38 into chamber 37. Fluid line 36 may move in said chamber 37 with its open one end and be sealed relatively to the outside from chamber 37. The other end of the fluid line 36 extends into member 82 and forms therein the first passage means of the invention. Control recess 35 forms the second passage means of the invention and passage 34 forms the third passage means of the invention and it ports into pocket 33 of the invention.

Thus, when member 82 does the rightward and leftward movement or strokes in FIG. 5, the second passage means 35 alternately communicates or discommunicates the third passage means with the first passage means and thereby leads alternately pressure in fluid into pocket 33, whereby the aim of the invention is materialized, that fluid pocket 33 carries a high load of member 82 at a stroke of high load, but does not supply such a high carrying power at the stroke under a less high load. Because at a lower load of member 82 the fluid pressure in pocket 33, might, if applied, lift the member 82 away from the wall-face 32.

Element 3 may in addition serve to guide the movement and the location of member 82 along wall face 32.

The expression:—non-circular cross-section—shall for example, define, that the cross-section has at least one corner or at least one straight line, which define a corner or a face on the respective recess or element. The complementary of cross-section of recess(es) and element(s) then prevent rotation relatively to each other by the said corner or face.

Figure 11:
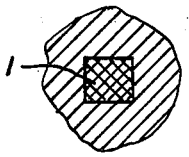
FIG. 11 is a sectional view through a portion FIG. 9 along XI—XI.
Figure 12:
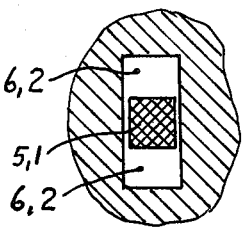
FIG. 12 is a sectional view through FIG. 9 along XII—XII.
Figure 9:
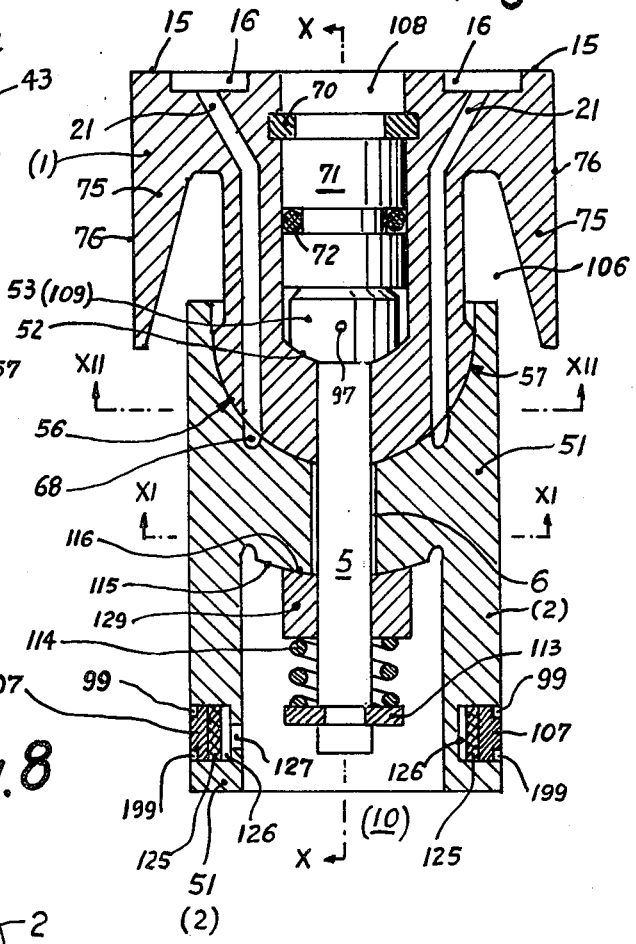
FIG. 9 is partially an enlargement of FIG. 28 of my mentioned grand parental application, now U.S. Pat. No. 4,037,523 and thereby a longitudinal sectional view through a portion of still another embodiment of the invention wherein several means are added, which are not present in the mentioned U.S. Pat. No. 4,037,223.
Figure 10:
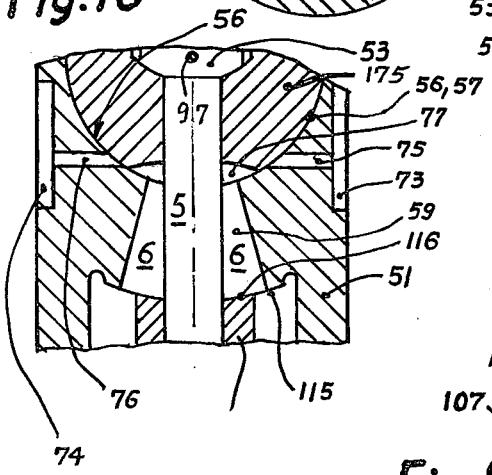
FIG. 10 is a sectional view through a portion FIG. 9 along X—X.

FIG. 9 with thereto belonging cross-sections in FIGS. 10, 11 and 12, is merely a repetition of FIG. 28 of my grand-parental U.S. Pat. No. 4,037,523; however in an enlarged scale and with improvements by this invention to the present stand.

It provides a piston and piston-shoe assembly, which is pivotably connected together by seat(56,57), holder (109), (129) and (113), which is freely floating radially in the respective cylinder (10). The referential numbers in parantheses indicate those of the grand-parental patent.

The modifications by this present divisional are, that the holder 5 is not circular as in the grand-parental, but represents the element 5 of non-circular configuration, in this case of a cross-section of a square and that the recess 6 or 2 also has a non-circular cross-sectional configuration of the present divisional. In order to provide the pivotability in one of the recesses, at least one recess 6 or 2 is elongated in the direction of the pivotal swing. This is clearly seen in FIGS. 11 and 12, as well as in FIG. 10. Within member 75 the recess may be a square conforming to the square section of element 6, while the recess 6 in member 51 has the corresponding enlargements to a rectangle or to a rectangular taper in the direction of the longer side of the rectangle.

This makes it possible to provide the pockets 73 and 74 in the area of movement and direction of load and to port the second passages 75 and 76 into them. The third passage or recess 77 takes then over the alternating communication and discommunication at the pivotal movement of member 75 on member 51. The details of the FIGURE are described in the mentioned grand-parental patent and in the parental application. The mentioned parental application is now U.S. Pat. No. 4,193,336 which issued on Mar. 18, 1980. Ball-part formed face of pivot portion 175 is borne on spherical bed face 56 and able to slide and pivot thereon. End faces 76 of member 75 are kept between the respective retaining walls of one of the bodies and thereby prevented from rotation around the axis of element 5. The non-circularity of recess 6 and element 5 prevent rotation of member 51 relatively to member 75, whereby the pockets 73,74 are alltimes kept within the direction and concentration of the load directed from member 51 against the respective space-wall or space-face. Passages 21 lead fluid from collection space 68 into radial balancing pockets 16. Pockets 16 are closed by one of the bodies. For example by the inner face of the piston stroke activator 33 of the grand-parental patent.

Member or piston shoe pivot-portion 175 has a seat 52 for the reception and bearing of head 53 (109) of element 5. The said seat 52 is closed upwardly by the insertion of a closure means 71. Closure 71 may have or contain a seal means 72 to seal seat 52 upwards in the figure. Closure 71 may be kept by a holder 70, which may be a snap ring in member or piston shoe 75(1). The radially inwardly extending portions or extension 75 of the member or piston shoe (1) may be provided to enter them at a deep diving piston stroke into the grooves 61 of FIG. 13.

Element 5 extends from said seat 52 through recess 2,6 in member 175 and through recess 6 in member or piston 51 while it remains able to swing in recess 6 in member 51 and it extends further downward beyond a portion and seat 115 of member 51. There it carries a holder-body 129 which has an inner face 116 of a configuration of a radius around the pivot-center 97. Bearing face 115 has a complementary configuration of a substantially equal radius and carries said inner face of holder body 129. Fastener or snap ring 113 holds and spanns a spring means 114 which presses the holder body 129 against face 115 and thereby forces the faces 56,57 of the bed and face of the pivotal bearing of the member (1) or piston shoe (1),75 on the bed and face 56 of member or piston 51 for close sliding engagement together and holds them together. The spanning force of means 114 is of a suitable strength to permit the pivotal movement of member (1) and to permit the slide of face 56 on face 57.

Member 51 has preferably close to its bottom, an annular groove 126 for the reception of a piston ring or seal means 107. Mean 107 has at least one outcut 99 or also an additional outcut 199. A plastic seal means or O-ring 126 is inserted into the groove 126 below the ring or seal 107. A passage 127 leads fluid under pressure from space or cylinder chamber (10) into groove 126 and below plastic seal 125. Thereby the seal 125 is pressed against seal means 107 and seal 107 is deforming uner said pressure radially outwardly against the respective wall-face to seal thereagainst. The outcut(s) 99,(199) make sure, that the force from groove 126 is stronger than a force which might develop outwards of means 125. The cut-off 99 makes the outer face of means 107 shorter than the inner face thereof, whereby the higher force on the inner face of means 125 is assured and the desired deformation radially outwardly for sealing on the respective wall face 314,414 (for example) is secured in combination with the pressure supply through passage 127.

FIGS. 13 to 15 are those of FIGS. 32 to 34 of the parental application. However in an enlarged scale and more clearly written.

The embodiment of the invention shown in FIGS. 13 to 15 is specially suitable for high pressure motors or for self-suctioning pumps or compressors.

A self-suctioning pump prefers a piston and piston-shoe assembly, where piston and shoe are connected together, so, that they can not depart away from each other. Because the self-suctioning pump has no pre-pressure in the suction line. The piston can not be pressed radially outward by fluid. On contrary, it has to serve to draw in fluid.

When such self-suctioning pump shall operate under the highest pressure, however, the highest cross-sectional area of bearing portion between piston and piston shoe is desired. That prevents embracement of piston and shoe relatively to each other, because embracement arrangements would take too much area on the outer portions of the pistons away from bearing purposes.

When the device acts as a motor or as a pump under very high pressure, the pivotal movement of the piston shoe provides a tangentially directed force-component on the piston, whereby piston 202 is pressed one-sidedly against the wall of the cylinder. This appearance is generally known from some of my earlier patents. But there were no means heretofore to prevent such appearance at pistons with part-spherical heads.

Due to the arrangement of said FIGS. 32 to 34 of the parental application Ser. No. 765,221, which is now U.S. Pat. No. 4,193,336, which issued on Mar. 18, 1980, it is now however possible in accordance with this invention to provide and operate tangentially pressure balancing pockets 281 and 282 also in pistons with part-spherical piston heads. Control-recess 233 in radially inward projecting portion 293 opens and closes passages 283 and 282 to pockets 281 and 280 during the pivotal motion of portion 293 similarily as in inventor's U.S. Pat. No. 3,225,706. Such action can be effective however only, if the piston is prevented from rotation relatively to the piston shoe. In order to achieve this, the holding pin 285 is provided in piston 202 and shoe portion 293. Holding pin 285 has a preferably ball-formed head 287 and extends therewith into a bore in poston shoe portion 293. It is pivotably fastened therein by cross-pin 286 whereby relative rotation between pin 285 and shoe portion 293 is prevented. The piston 202 is provided with a profiled recess 289 and pin end 288 is complementary profiled. So, that pin end 288 can axially move in profile piston 289, but is prevented from rotation therein. In the FIGURES the profile is shown as of sixangular cross-section, expecially demonstrated in FIG. 34. But the profile can be on any other suitable configuration which prevents rotation of the piston 202 around the pin 285. A retainer means 290 may be provided in order to retain springloaded or non-springloaded the piston 202 on pin 285. In such case, the piston and piston shoe are connected together by pin means 285 and the thereto associated means.

If no retainer means is set to retainer 290, the piston and shoe remain un-connected relatively to each other. The free floating of the piston shoe remains. Because the profiled portion 288 can freely move radially in the machine, which is axially in the piston 202. When piston shoe portion 293 moves radially away from the piston 202 and the said gap opens, the pin means 285 moves within said piston 202. Piston and shoe remain thereby radially free of each other, while prevention of relative rotation between piston and shoe remains prevented. Control of flow into tangential balance pockets 281 and 280 is immediately asssured again, when the gap between piston and shoe is closed again. The correct direction and location of pockets 280 and 281 relatively to the wall of the cylinder 210 is secured by the means of FIGS. 32 to 34 or by similar effective arrangements.

Equalness or almost equalness of radii 230 and 231 assures closely guided co-axial movement of piston and shoe in cylinder 210. Innermost faces 299 on end elements are radially plane faces without any extensions inwardly beyond said plane faces. Thereby it is assured, that either the piston shoes alone, if they are unconnected to the pistons, or the piston and piston shoe assemblies, when pistons and shoes are connected to each other, can move unhindered by end elements freely radially between said innermost faces 288 of end elements 214. To prevent axial de-location of piston shoes, the end faces 298 of the piston shoes may get respectively close or non-close fits relatively to the said innermost faces 299. Another means for prevention of dislocation of piston shoes is the equalness or almost equalness of radii 230 and 231 of the respective piston head and of the respective radially inwardly projecting portion of the respective piston shoe.

According to this present application, the pin 285 forms the element 7 and it is located in the non-circular recess(es) 8,62. It is able to swing in recess 8. Rotor 209 constitutes one of the bodies which forms the retaining portions 214 to keep the endfaces 298 of member 291, 293 directed in one of the possible dimensions. The other member is 202 and it carries the first passage means 9, which may be a clearance of the element 7 in recess 62 or a passage 9 as shown in FIG. 15. The second passages are formed by references 282 and 283 in FIG. 14 and the third passage means is recess 8 or 233. Radii 230 define the spheric pivot-bearing between members 202 and 293. Body 209 may have radially inwardly or otherwise, suitably extending grooves 61 for the reception member extensions as for example extensions 75 of FIG. 9 to provide a large extent or stroke of the movement which is discussed in this application.

In the parental application the FIGS. 13 to 15 were also defined as excluding outer portions of the piston or member 202 from holding the other member 291 on piston or member 202. Thus, the major intention of the figures in the parental is, to make the radius 230 of the pivot-bearing equal or almost equal to the radius of the piston or other member 202.

On contrary thereto, in accordance with this present application, the radius 230 may be shorter than radius 231 in FIG. 14 in order to extend the outer portion of member 202 more upwards towards the pivot center 286 or even upwards beyond it in FIGS. 13,14 in order to provide larger areas of the pocket of the invention in order to carry a higher load by the pocket(s) 280, 281.

That brings the disadvantage, that the radial bearing capacity of the pivot-bearing with radius 230 becomes smaller, but the carrying capacity of the pocket increases. The consequence thereof is, that the restriction in the parental is more useful for devices with smaller pivot-angles. But the figures and definitions of FIGS. 13 to 15 of this application are more useful for bigger pivot-angle applications. The greater pivot-angles bring greater load to the respective member and wall-face. Since however, a greater angle of pivotion brings in a given device of a given certain outer diameter a longer stroke of the movement and thereby a greater power, even when the pressure in the fluid becomes a little smaller.

FIG. 16 demonstrates a possible modification of the invention. Namely, that the at least one pocket may be constituted by the second passage means 45 of the figure, or by the outer port thereof. The specifity of FIG. 16 consists in such case therein, that at elast one additional pocket, namely a wall-pocket, in and through the respective wall-face of the respective space or cylinder (10) 14 is provided whereby said additional pocket 86 in body 22(9) ports into the outer port of second passage means 45 and thereby communicates with it. Pocket 86 is then filled alternately with fluid under pressure and takes over the function of the at least one pocket of the invention, which is, to carry at least a portion of the load excerted by one of the members, for example by members 29 or (2) in FIG. 16.

FIG. 17 demonstrates, that the force out of space 14 is reflected from body 23 by an angle gamma and appears then as force "F-1". The angle gamma defines the relation of the tangential forces component "Ft" in relation to the radial component of force "FR" by the equation $$Ft = Fr \text{ multiplied by tangent gamma.}$$

Thus, a small angle gamma gives a smaller load of member 29 on wall 314,414, but a greater angle gamma gives a greater such force. FIG. 21 will later show, that at an angle gamma larger than a45 degrees, the force may even be increased over the original force out of space 14.

FIG. 18 shows the decisive portion of FIG. 16 in an enlarged scale and demonstrates, that the lateral or tangential force "Ft" of FIGS. 16 and 17, represented by referential 88 is carried by a contrary directed force 488 which acts in pocket 86. That reduces the load on wall face 489 and acts against the outer face 89 of member 29 to secure a smooth stroke or movement of face 89 along face 489.

In FIGS. 19 and 20 the member 29 carries in space 14 a member 29 which is associated to a pivotable member 501. The member include the known recess 2, element 1, first passage 2, second passage with end-diget 45 and the third passage 47 as well as the spherical pivot-portion with bed and faces 49,50 or 56, 57 of the earlier described figures. The pivot-portion 18 is also provided.

By a reason, which will be seen soon, the pocket with end-diget 546 forms however a much larger pocket, than the pocket 45 of the figures earlier.

Body 523 forms a pair of very stiff guide faces 502 for the guidance of the member 501. In the figure the angle of attack=gamma is written to be for example 60 degrees. See also FIG. 21.

Member 501 carries on a pair of bearings 504 the rollers 503, which roll along the guide face 502.

FIG. 20 has an upper portion showing a portion of FIG. 19 in section XXI—XXI and a bottom portion showing the section XX—XX of FIG. 19 in part. The double section is provided to demonstrate in a single FIG. 20 the action of guide face 502 in relation to roller 503 and at same figure the action of pocket 546.

The spherical pivot-bed or bearing 49,50 is preferrred here to adjust probably machining mistakes of faces 502 by a second slight pivotability of portion 18 around center 286. The second pivotal movement, when it appears at all, is then done in a plane substantial normal to the medial plane of the first pivotal movement, the general pivotal movement of the invention.

The force excerted from space 14 onto member 29 is equal to the area of the bottom of member 29 multiplied with the pressure in space 14. When the member 29 is a piston of diameter "d",the bottom area will be $(d)^2$ pi/4 or d×d×o,7854.

Assuming a piston of 2 cm diameter as in small pumps or motors, we obtain for for example 800 atmospheres pressure in space 14:

Radial force=Fr=2 cm×2 cm=4 cm×0,7854=3,14 $cm^2$×800 atm. which gives =2 5 1 2 Kg radial force Fr.

Radial force Fr=507 (FIG. 21) must be transformed by the equation in FIG. 17 into a tangential component of force, namely 505 which acts as the load of member 29 on wall-face 502. For gamma=60 degrees as in the figure, the equation gives:

$Ft_2 = Fr + g\gamma$ *for* 60°γ and *Fr* 2512 Kg=$Ft_2$=2512×1.732=4350 Kg.

Comparing for equal Fr the angle gamma about 10 degrees of

FIG. 17, the Ft would be:

$Ft_7$=2512 Kg×0.1763=≈443 Kg.

The above simple calculation of two extremities shows for example:

(a) That the stiff inclination of the angle of the guide face of the piston stroke guide, which becomes possible by this embodiment of the invention, not only transfers the whole of the radial force into torque, but it can even transform the radial force into a x-times higher force in the direction of the torque and thereby produce a very high torque; and;

(b) That a so produced torque can even be roughly ten times higher than the torque of an allready deep diving piston and shoe with about ten degrees inclination of the piston stroke guide face. In radial piston devices with outer piston shoes, as in the common art, the inclination is even less than ten degrees and the resulting torque even smaller.

On the other hand, such steep increase in torque results naturally in a slower rotary velocity, because otherwise the acceleration forces in the device would become too high.

FIG. 21 shows, that the angle gamma is here about 60 degreees, which gives a tangent gamma of 1.732. That means, as the figure shows, that the tangential force Ft in the direction of the torque becomes 1.732 times of the radial force Fr. The tangential force 505, which produces the torque of the motor, is now 1.732 times stronger, than the radial force 507. The figure also shows, that the fluid in the pocket 546 creates a fluid pressure field 508, which acts against the torque-force 505 in opposite direction and thereby balances the force of torque 505 which is transfered from guide face 502 over the rollers 503 onto the piston-shoe 501, and via the pivot-portion 18 onto the piston or member 29. Thereby any major or all friction between the wall 509 of member or piston 29 and wall 414 of space 14 is prevented.

Since however, the fluid pressure field 508 acts also in the opposite direction, the fact appears, that the force of torque 505, transferred from the above described parts onto the wall 414 of space 14 and thereby onto the body or rotor 22, is not any more transferred by mechanical, friction causing force, but by the force of fluid under pressure with almost none or only a remaining minimum amount of friction between the walls or faces 509 and 414.

Since rolelr 503 is borne on face 502 of body 523, and neither the body 523 nor the face 502 can move backward or in any other way away from where they are, because they are stationary, the rearwardly directed force of fluid out of pocket 546, which acts against the piston 29, acts over piston 29 against the non-moveable face and body 502, 523 which can not move away from where they are, the consequence thereof is, that the forewardly directed force of fluid out of pocket 546, which is directed against the wall 414 of the respective cylinder of the rotor 22, produces a torque on wall 414 of rotor 22 and this torque is revolving the rotor 22, because the wall 414 is the single means in the arrangement whbich can under the forces of fluid in pocket 546 move away, because it is the wall of the single moveable means, namely of the rotor 22, which is revolvlingly borne in the device.

The rollers 503 in FIGS. 19, 20 are rolling on portions 504 of piston shoe 501 around axes 586, which are extended by length 587 from pivot-center 286. Element 1 limits the pivotion to angle 588 just enough to assure the communication between recesses or passage 2 and 45 over recess or passage 47. When however, the pockets 546 would be in the body 22, as described in FIG. 15 of my later filed,, now co-pending application Ser. No. 119,349 and the control of the alternation of the flow of fluid into respective pockets in body 22 would be applied, then the pivotion is not necessary and the pivotion to angle 588 as well as the distance 587 can then be spared.

In FIGS. 6 and 22 to 23 it is shown, that it is suitable to prevent, that the element 1 can move against the inner wall of the body 23 or to the guide face thereof. Because if it could do so, it might scratch and cause friction there. In FIG. 6 that is accomplished by the stoppers 48. In FIGS. 22 and 23 it is made by inserting a retainer, like a pin 602, which might be nutted or rivetted. It extends through portion 618 and through element 1, thereby holding element 1 in pivot-portion 618. In such application the problem arises, that there might be no space left for setting the passage 3 to the radial pocket 19. FIG. 22 therefore demonstrates, that two passages 603 may be set laterally of the element 601 to bring the desired result. If they would be set through the sectional plane of FIG. 23, passages 603 would surround retainer 602, whereby it might become necessary to seal retainer 602 axially toward the outside.

In FIGS. 22 to 28 those portions, which have equal referential numbers as in other figures demonstrate equal portions as in other figures.

FIGS. 24 and 28 demonstrate an embodiment of the invention, wherein the member 729 is not prevented from rotation relatively to the other member 717. Piston shoe 717 is guided by the end-walls of one of the bodies, but, since the pivot-bed 28,749 and the pivot-portion 718 are spherical, the piston 729 is not prevented from rotation relatively to piston-shoe 717.

As the specification teaches at hand of the other figures, such an arrangement is not an ideal solution. However, sometimes it might be done. And, when it becomes done and applied, then other methods of leading fluid into the required pocket are needed. Those other methods are demonstrated in these figures.

The member 729 gets a plurality of pockets with thereto communicationg second passage means located under angular spacing around the periphery of piston or member 729. Since piston shoe or member 717 is prevented from rotation because it is guided between the retaining walls on one of the bodies, the third passage or recess 47 remains directed in one single dimensions. This direction is toward the portion of the wall face of the respective space or cylinder, wherein the movement under tangential load of the invention occurs. When now piston or member 729 revolves around its longitudinal axis in passage 702, fluid pockets 746-745-b and 742-743-a revolve away from the mentioned area of movement. But then another pair of passages and pockets b to l moves into communication with third passage or recess 47 and takes then over the fluid under pressure to provide the pressure forces in the area of movement or at least in the close neighborhood of the area of movement under load of the invention. When the piston or member 729 is short and its upper end remains below the outer portion of the other member or piston shoe 717, a tilting force might appear on the member or piston 729 close to the bottom thereof and be directed oppositional to that of the main pockets 745,746 a to l. A counter-directed pocket pair set 711—712 may then be applied as seen in FIGS. 24 and 28. Respective passages 713 or 714 will then communicate the respective higher located main pocket 746 with the respective counter pocket 711 or pocket 743 with counter pocket 712. A number of such counter pockets 711,712 may be provided and be supplied by passages, which like passage 713,714 inclined through member or piston 729 at different heights and different angular spacement along lines XXVIII—XXVIII of FIG. 24 and in the gist of FIG. 28.

As far as bodies in this specification have been called rotors and others actuator means or piston stroke actuator guides, it should be understood, that the functions might become reversed, when the housing or outer body of the arrangement revolves and the inner body is stationary. That may, for example, be the case, when the inner body is fastened in a vehicle to drive the outer body in a rotary movement. For example, to carry and to drive the wheels of a vehicle, or respective other revolvable members.

In FIG. 16 the eccentricity 85 is shown between the axes 83 and 84 of bodies 23 and 22.

I claim:

1. An arrangement to reduce friction in device which includes at least two bodies, two members and at least two faces, wherein said faces slide along each other under a pivoting load;

wherein one of said bodies contains a space for the reception of at least a portion of one of said members;

wherein one of said members is provided with a bed to bear thereon a pivot portion of the other of said members;

wherein said members pivot relative to each other in alternating opposite directions when one of said members is borne insaid bed of the said other of said members;

wherein one of said members does a movement in said space whereby it slides with it outer face along a respective wall face of a wall which borders said space, wherein said bodies include retaining portions located on opposite ends of said members to limit the extent of said movement, wherein at least one of said bodies forms parallel retaining-walls on two opposite sides of one of said members;

wherein at least one pocket is provided in one of said members and open toward said wall face;

wherein one of said members is provided with a first passage means communicated to a chamber with fluid under pressure and a second passage means communicating with said pocket;

wherein a third passage means is provided in the other of said members for communication with said first passage means and alternating communication and discommunication with said second passage means during said pivoting of said members;

wherein at least one of said bed has an inner recess of a non-circular cross-section;

wherein said recess is open toward the other of said members;

wherein an element of a cross-section which is at least partially complementary to said cross-section of said recess, is attached to one of said members and extends into said non-circular cross-section recess of the other of said members;

wherein said passages supply at least periodically fluid into said pocket, serve to maintain fluid and pressure in said pocket and to carry at least a portion of the load of said member on said wall face;

wherein said pocket is located in the direction of the load of the respective member onto said wall face;

wherein said movement includes an oscillation with a stroke under load and another stroke under less load;

wherein said movement is present along the concentration of said load of the respective member onto said wall face; and;

wherein said recess and said element serve to maintain an equal direction of said members relative to each other whereby they maintain said direction of said load and keep said movement in said concentration and direction of said load by preventing displacement of said pocket out of said concentration and direction of said load.

2. The arrangement of claim 1,
wherein said retaining wall guide said sides of said one member for maintenance of one direction of said member and whereby said recess and said element transfer said maintenance to said other member to maintain one of the directions of said other member and thereby to maintain said pocket in said concentration and direction of said load.

3. The arrangement of claim 1,
wherein said recess includes an enlargement in one direction to facilitate in said enlargement a pivotal movement of said element relatively to one of said members.

4. The arrangement of claim 1,
wherein said bodies are actuating said movement.

5. The arrangement of claim 1,
wherein said pocket is constituted by the outer port of said second passage means and an additional wall-pocket is provided in and through the respective wall of said space in one of said bodies and porting into said outer port of said pocket.

6. The arrangement of claim 1,
wherein the other of said members has a second inner recess and said element extends into both of said inner recesses.

7. The arrangement of claim 6,
wherein said element is freely able to move in axial direction of said element in said recesses,
wherein said limit of extent of said movement is shorter than the length of said element and wherein at least one of said members is longer in said direction of said axis than said limit, whereby escape of said element from said recesses in said members is prevented.

* * * * *